US007908798B2

(12) United States Patent
Monneret

(10) Patent No.: US 7,908,798 B2
(45) Date of Patent: Mar. 22, 2011

(54) DEVICE FOR CLOSING A FRAME HAVING A PANEL ARTICULATED ON THE FRAME

(75) Inventor: Jean-Jacques Monneret, Lyons (FR)

(73) Assignee: Norinco, Saint Crepin Ibouvillers (FR)

( * ) Notice: Subject to any disclaimer, the term of this patent is extended or adjusted under 35 U.S.C. 154(b) by 1117 days.

(21) Appl. No.: 11/617,869

(22) Filed: Dec. 29, 2006

(65) Prior Publication Data

US 2007/0186381 A1 Aug. 16, 2007

(30) Foreign Application Priority Data

Feb. 14, 2006 (FR) ..... 06 50520

(51) Int. Cl.
*E02D 29/14* (2006.01)

(52) U.S. Cl. ..... 52/20; 49/397; 49/398; 49/400; 49/465; 16/267; 404/25

(58) Field of Classification Search ..... 49/397, 49/398, 400, 463, 465; 16/266, 267, 260; 52/19, 20, 21; 404/25
See application file for complete search history.

(56) References Cited

U.S. PATENT DOCUMENTS

| | | | | |
|---|---|---|---|---|
| 4,508,469 | A * | 4/1985 | Dumortier | 404/25 |
| 5,017,039 | A * | 5/1991 | Spiess et al. | 404/25 |
| 5,160,213 | A * | 11/1992 | Spiess et al. | 404/25 |
| 5,269,046 | A * | 12/1993 | Newby, Sr. | 16/267 |
| 6,003,204 | A * | 12/1999 | Roach et al. | 16/267 |
| 6,749,363 | B1 * | 6/2004 | Petersen | 404/25 |
| 6,957,927 | B1 * | 10/2005 | Petersen | 404/25 |
| 7,108,447 | B2 * | 9/2006 | Akkala et al. | 404/25 |
| 2004/0128919 | A1 * | 7/2004 | Hauer et al. | 52/19 |

FOREIGN PATENT DOCUMENTS

| | | |
|---|---|---|
| EP | 0 451 064 | 10/1991 |
| EP | 0 814 204 | 12/1997 |
| EP | 0 856 611 | 8/1998 |
| EP | 1 160 382 | 12/2001 |
| EP | 1 201 829 | 5/2002 |
| GB | 2 388 864 | 11/2003 |

* cited by examiner

*Primary Examiner* — David Dunn
*Assistant Examiner* — David E Allred
(74) *Attorney, Agent, or Firm* — Leydig, Voit & Mayer, Ltd.

(57) ABSTRACT

A device for closing a frame, which has a panel mounted removably on and articulated on the frame includes a hook that has, at an end part, a heel that can stop against a surface of the articulation edge of the frame to immobilize the panel in a secure open upright position, generally perpendicular to the frame. The invention can be applied to roads.

7 Claims, 3 Drawing Sheets

1
2
2a
3
4
5b
5c
7
8
9
12
13
14
15a
16
16a
17
A

DEVICE FOR CLOSING A FRAME HAVING A PANEL ARTICULATED ON THE FRAME

FIELD OF THE INVENTION

The present invention relates to a device making it possible to close a frame, which has a panel, such as a plug or cover, mounted in a removable manner articulated on a frame.

It applies in particular to road fittings allowing access to drains buried in the ground.

BACKGROUND

Known through French patent No. 2 815 979 is a device for closing the opening of a frame by a panel mounted in a removable manner articulated on the frame by a hook connected to the panel and provided with an articulation eye in which a hinge pin is engaged, which pin has a flat part with an inclination relative to the frame greater than a right angle so that the panel can be mounted on the frame or extracted from it only in an open position overturned at approximately 110°.

According to this known device, the hook has, at its free end, a heel which, in the open overturned position of the panel, falls to rest along a steep side of an inclined cam of the articulation edge of the frame so as to immobilize the panel in its open position relative to the frame and to the hinge pin by four stop points. This arrangement has the disadvantage that the operator has difficulty freeing the panel from its four stop points by lifting and allowing the tilting of the panel to its position for closing the frame.

SUMMARY OF THE INVENTION

The present invention aims to eliminate the disadvantage above of the known device by proposing a device that allows the panel to tilt freely from its overturned opening position and that makes it possible to immobilize the panel automatically in an upright position roughly perpendicular to the frame when the panel is tilted accidentally from its overturned opening position to its position for closing the frame.

To this effect, according to the invention, the device making it possible to close a frame, which has a panel, such as a plug or cover, mounted in a removable manner on the frame by a hook connected to the panel and provided with at least one internal lateral opening whose edges are configured in the form of inclines cooperating with a hinge pin connected to an articulation edge of the frame and engaged in the lateral opening of the hook in order to control the pivoting of the panel from its opening position to its position for closing of the frame in which it is inscribed in the peripheral rim of the frame and is applied on a rabbet of the frame or vice versa, the hinge pin having at least one flat part which, with respect to the frame, has an inclination greater than a right angle, and the lateral opening of the hook emerging at the end of the hook through a guide of reduced cross section, which allows the engagement of the hinge pin in the lateral opening of the hook by mutual drawing of the panel in open position near to the frame only according to an angle of inclination of the panel relative to the frame that is determined by the angle of inclination of the flat part of the hinge pin so that the panel can be mounted on or removed from the frame only in an overturned position, is characterized by the fact that the hook and the hinge pin allow free tilting of the panel from its overturned open position to its closing position, and the hook, at an end part, has a heel that can stop against a steep side of the articulation edge of the frame in order to immobilize the panel in a secure open upright position roughly perpendicular to the frame when the panel is tilted accidentally from its overturned open position, the hinge pin and the inclines of the lateral opening of the hook cooperating in order to prevent extraction of the panel occupying its secure open upright position from the frame while allowing the tilting of the panel to its position for closing the frame from its secure open upright position.

Preferably, the hook has a second lateral opening separated from the first lateral opening by a sheet of material of the hook and whose edges configured in the form of inclines cooperate with a second hinge pin connected to the articulation edge of the frame engaged in the second lateral opening of the hook in order also to control the pivoting of the panel from its opening position to its position for closing of the frame or vice versa, the second hinge pin having at least one flat part with the same inclination as the flat part of the first hinge pin, and the second lateral opening of the hook emerging at the end of the hook through a second guide of reduced cross section allowing engagement of the second hinge pin in the second lateral opening of the hook by mutual drawing of the panel in overturned open position near to the frame only according to the angle of inclination of the panel relative to the frame determined by the angle of inclination of the flat part of the second hinge pin, and the inclines of the second lateral opening of the hook cooperating also in order to prevent extraction, relative to the frame, of the panel occupying its secure open upright position.

The two hinge pins are coaxial, and each hinge pin has a second flat part opposite and parallel to the first flat part.

The articulation edge of the frame has a lower planar surface inclined downward towards the exterior of the frame and ending towards the interior of the frame with the stop side for the heel of the hook.

In the secure opening upright position of the panel, the hook rests by its other adjacent end part without the heel on the inclined surface of the frame and is stopped by the corresponding incline of each lateral opening against the corresponding hinge pin.

In its overturned opening position, the panel rests by its other adjacent end part of the hook without the heel on the inclined planar surface of the frame and by its external surface on an upper inclined surface of the rim of the frame, and is stopped by the corresponding guide with reduced cross section against the associated hinge pin.

The heel of the hook has a shape in cam form arranged on the exterior lower corner of this heel and cooperating with the inclined surface of the frame in order to control the pivoting of the panel during its tilting.

According to one embodiment, the articulation edge of the frame consists of a lug projecting outside the frame, intended for receiving the hook of the panel and of which each hinge pin is arranged transversely in the lug.

The panel can be circular, and the hook extends radially from this panel, whereas the lug is connected radially to the circular frame.

The panel is inclined to its overturned open position according to an angle between approximately 110° and approximately 120°.

BRIEF DESCRIPTION OF THE DRAWING FIGURES

The invention will be better understood, and other aims, characteristics, details and advantages of it will appear more clearly in the course of the following explanatory description in reference to the appended drawings given only as examples illustrating an embodiment of the invention and in which.

DETAILED DESCRIPTION

Figure 1:
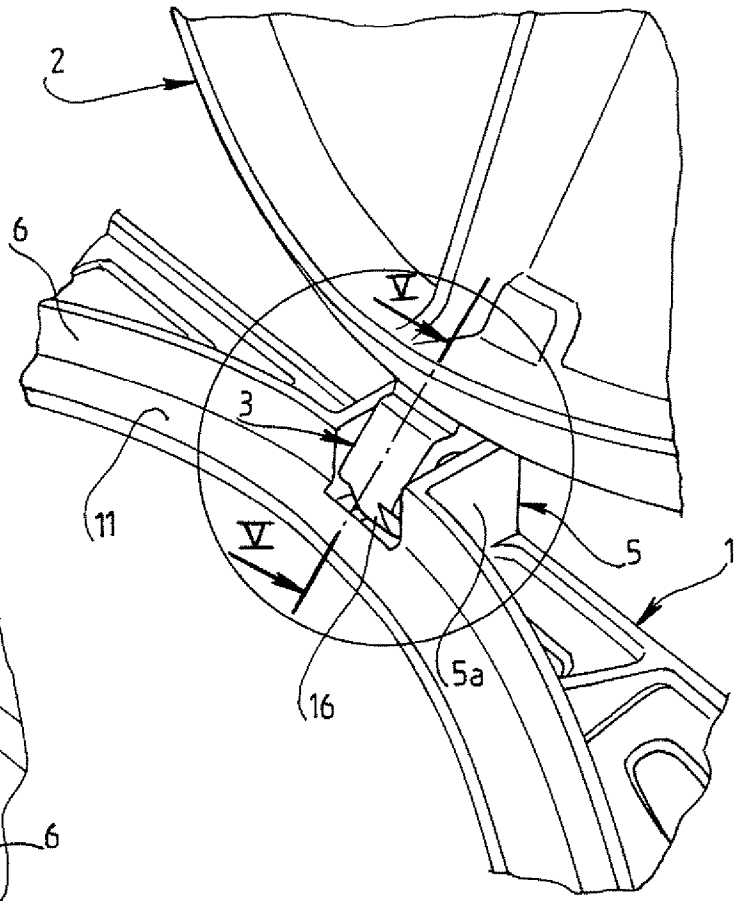
FIG. 1 is a partials perspective view of a road fitting with a panel mounted in a removable manner and articulated to a frame.
Figure 2:
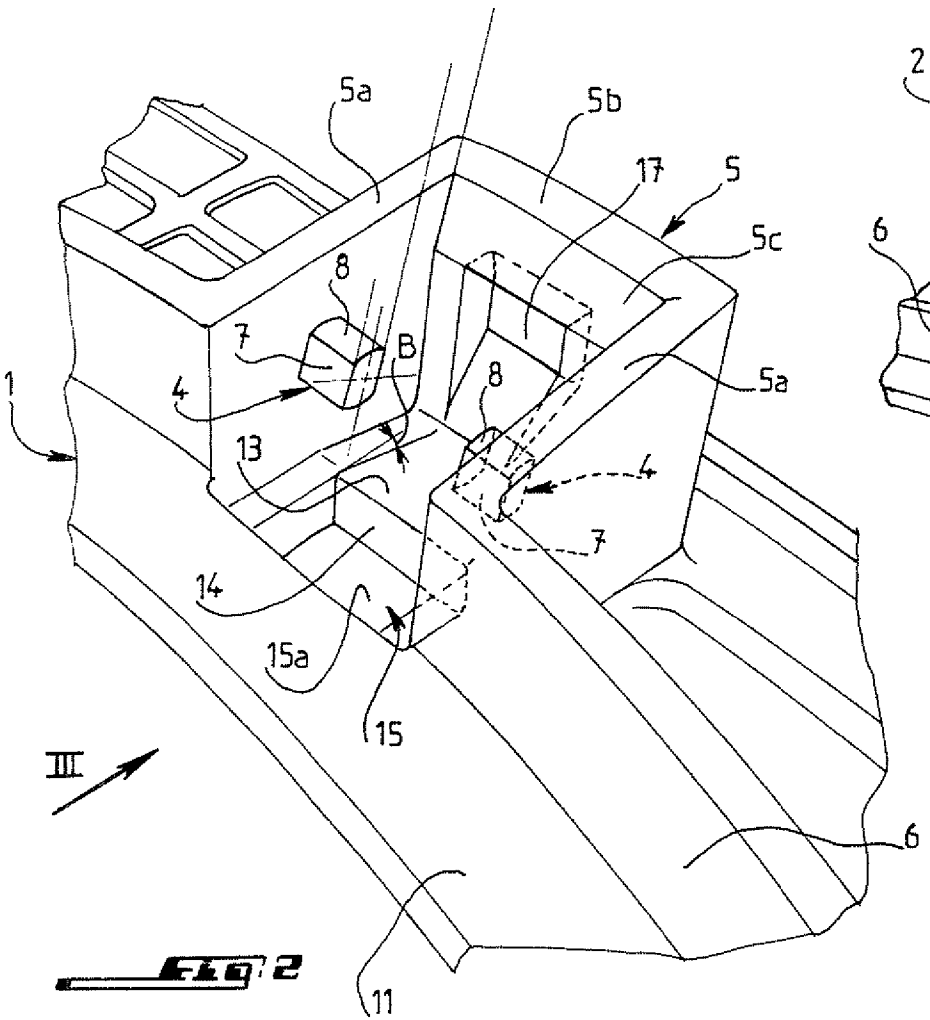
FIG. 2 is an enlarged perspective view of the circled part of FIG. 1 without the panel.
Figure 4:
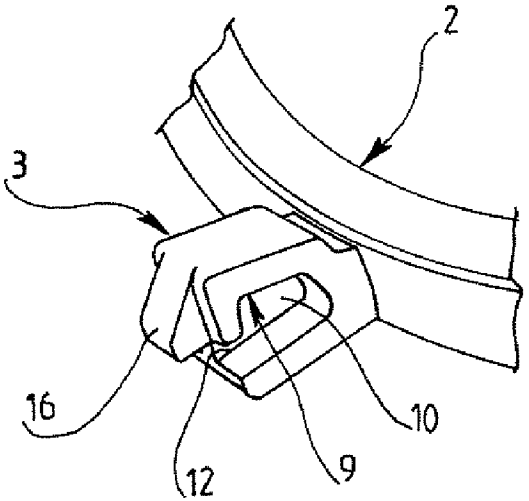
FIG. 4 is a perspective view of the hook for articulation of the panel to the frame of the road fitting.
Figure 3:
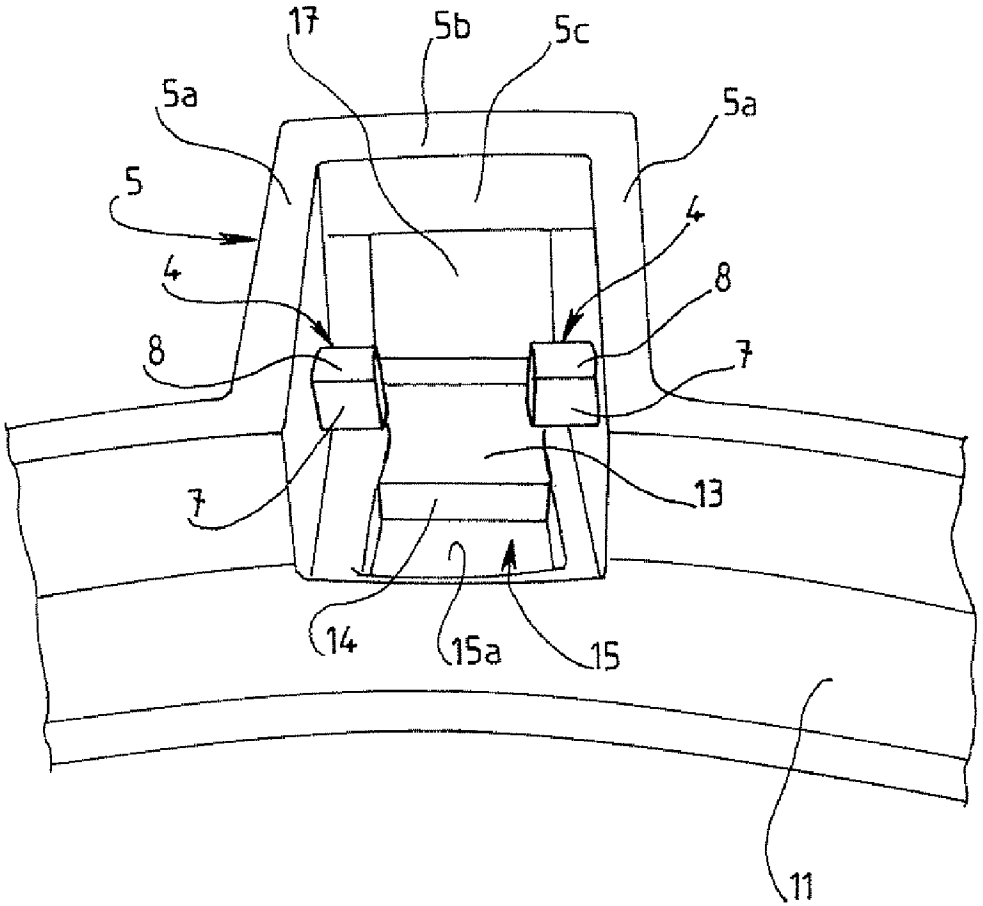
FIG. 3 is a front view taken along arrow III of FIG. 2.

The device of the invention will be described as applied to a road manhole composed of a circular frame and a circular capping element or plug or cover panel making it possible to close the frame, but it is quite obvious that it can apply to a road manhole whose frame can be rectangular and closed by at least one rectangular or triangular capping element.

The manhole represented in FIGS. 1-10 therefore has circular frame 1 and plug 2 provided with radial hook 3 that is mounted articulated on two coaxial hinge pins 4 arranged transversely in lug 5 projecting exteriorly from peripheral rim 6 of frame 1 bordering the opening of this frame and in which plug 2 is inscribed in its position for closing the frame.

The articulation of plug 2 to frame 1 using hook 3 and pins 4 makes possible a rotation of the plug between a position for closing the frame represented in FIG. 5 and a position for opening this frame represented in FIG. 7, and also allows plug 2 to be extracted from frame 1 as will be described later.

Figures 5, 6, 7, 8, 9, 10:
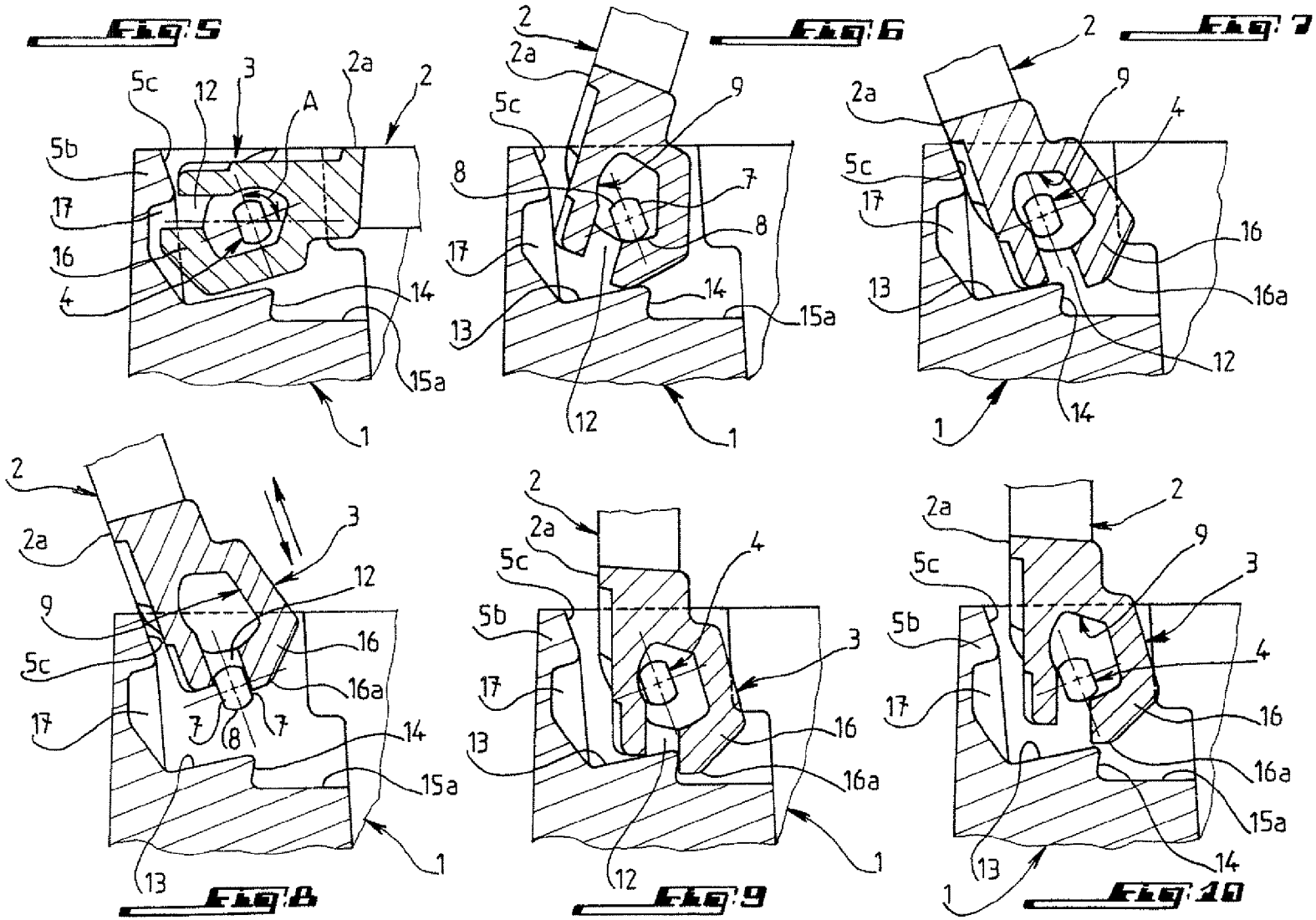
FIG. 5 is a partial view in section of the device of the invention taken along line V-V of FIG. 1, with the panel in the closed position.
FIG. 6 is a view similar to that of FIG. 5 and representing tilting of the panel from the closed position to the open position.
FIG. 7 is a view with the panel rotated to and beyond the opening position with respect to the frame.
FIG. 8 illustrates mounting of the panel to the frame and removing the panel from the frame when rotated beyond the open position of the panel.
FIG. 9 shows the upright position for immobilization of the panel with respect to the frame following tilting of the panel from beyond the open position of the panel toward the closed position.
FIG. 10 shows the releasing of the panel from the upright position of FIG. 9 without the possibility of extraction of the panel from the frame.

The two hinge pins 4 are connected to the internal surfaces of two lateral walls 5*a* of lug 5, and each of hinge pins 4 has, in cross section, at least one flat part 7, and preferably two opposite parallel flat parts, having, with respect to frame 1, an inclination A, as represented in FIG. 5, greater than a right angle, with it possible for the value of angle of inclination A of each flat part 7 to be between approximately 110° and approximately 120°. Each hinge pin 4 also has two semi-cylindrical lower and upper surfaces 8.

Hook 3 of plug 2 has two internal lateral openings 9 whose edges are configured in the form of inclines, and which are separated from one another by sheet of material 10 of hook 3 arranged roughly in the longitudinal median plane of hook 3. In the assembled position of hook 3 in lug 5, the two hinge pins 4 are engaged respectively in the two lateral openings 9 of this hook, the edges in the form of inclines of lateral openings 9 being intended for cooperating with the corresponding semi-cylindrical surfaces 8 of the two hinge pins 4 in order to control completely or partially the pivoting of plug 2 from its position for opening to its position for closing frame 1 or vice versa, plug 2, in position of closing of frame 1, being applied on rabbet 11 of frame 1.

Each of lateral openings 9 of hook 3 emerges at the end of this hook through guide 12 of reduced cross section constituting a groove whose parallel surfaces facing one another are separated from one another by a distance slightly greater than the distance separating the two flat parts 7 of the corresponding hinge pin 4.

The reduced cross section of guide 12 has the role of allowing engagement of the corresponding hinge pin 4 in associated lateral opening 9 of hook 3 by mutual drawing of plug 2 in open position near to frame 1 only according to an angle of inclination of this panel relative to frame 1 determined by the angle of inclination of flat parts 7 of hinge pins 4. In this way, plug 2 can be mounted on frame 1 or removed from it only in the overturned position of opening of frame 1 represented in FIG. 7 and in which external surface 2*a* of plug 2 rests on corresponding inclined upper surface 5*c* of end wall 5*b* of lug 5. In this overturned opening position of plug 2 corresponding to an angle of inclination of the plug between approximately 110° and approximately 120° relative to frame 1, plug 2 is maintained in position released from frame 1; and the operation of extraction or positioning of the plug is made simpler and therefore quicker and less delicate for an operator, as shown clearly in FIG. 8.

In its bottom, lug 5 has surface 13 inclined downward towards the exterior of frame 1 and ending towards the interior of the frame with steep side 14 separated from rabbet 11 by bottom wall 15*a* of lug 5 in order to define slot 15.

Furthermore, hook 3 has heel 16 projecting from an end part of the hook and it can stop against steep side 14, going into slot 15 when plug 2 is tilted accidentally from it overturned opening position of FIG. 7 to its closing position, in such a way as to immobilize plug 2 in opening upright position at an angle of roughly 90° with respect to frame 1, and consequently, to prevent, as a measure of safety, the tilting of plug 2 to its closing position as represented in FIG. 9. In this secure upright position of plug 2 heel 16 is stopped against steep side 14, the other adjacent end part of hook 3 without a heel resting by gravity on the inclined side in the form of incline 13, and the two lateral openings of hook 3 resting by their corresponding inclines respectively on the two hinge pins 4. It is understood that in the overturned opening position of plug 2 represented in FIG. 7 that the end part of hook 3 without heel 16 rests on inclined surface 13, and by the intermediary of the reduced cross sections of guides 12, on the corresponding hinge pins 4 with external surface 2*a* of this plug resting on inclined surface 5*c* of lug 5, so that plug 2 can tilt freely from this position to its closing position, either accidentally, in which case plug 2 is automatically immobilized in its upright position of FIG. 9, or in order to allow an operator to bring it to its position for closing frame 1.

When an operator has to pivot plug 2 to its position for closing of frame 1 from the secure upright position of FIG. 9, he lifts plug 2 relative to frame 1 according to a vertical direction as represented in FIG. 10 in order to release plug 2 from frame 1, and the corresponding inclines of lateral openings 9 of hook 3 cooperate with hinge pins 4 so as to prevent extraction of plug 2 from frame 1, that is to say that hinge pins 4 remain in position in their respective lateral openings of hook 3 without being able to escape from them. The operator can then tilt plug 2 to its horizontal position for closing frame 1.

Heel 16 of hook 3 has a shape in the form of cam 16*a* arranged on the exterior lower corner of this heel and cooperating with inclined surface 13 of frame 1 in order to control the pivoting of plug 2 during its tilting from the closed position shown in FIG. 5 toward the open positions of FIGS. 7 and 9. FIG. 6 shows the cam action between inclined surface 13 and heel 16 of the hook at cam 16*a*.

End wall 5*b* of lug 5 moreover has slot 17 hollowed in the internal surface of this wall in order to allow passage of heel 16 of hook 3 during rotation of plug 2 between its closing position and its opening position.

In the application to a rectangular or triangular capping element, the hook of this element can be mounted articulated to frame 1 by a lug as described in the preceding, with it possible for this hook to be mounted articulated between two walls or sheets bearing the two hinge pins 4 and perpendicular to rim 6 and to rabbet 11 of frame 1 in order to constitute an articulation edge of this frame having the same function as that of lug 5.

In order to ensure the mounting of plug 2 on frame 1, external surface 2*a* of plug 2 is placed resting on upper inclined surface 5*c* of end wall 5*b* of lug 5, and the operator, holding plug 2, causes it to slide it naturally by gravity along surface 5*c* until hinge pins 4 are successfully engaged in the grooves with reduced cross sections of guides 12 and lateral openings 9 of hook 3, as emerges from FIG. 8, and plug 2 is brought to its overturned opening position of FIG. 7. From this position, the operator can freely tilt plug 2 to its closing position by lifting this plug without risk of jamming of hinge pins 4 with lateral openings 9 of hook 3 of this plug.

The invention claimed is:

1. A device for closing an opening, the device comprising:
a frame including
a peripheral rim surrounding a central opening,
a substantially planar laterally projecting rabbet, projecting inward, toward and surrounding the central opening, and
a lug having a first lateral wall transverse to the rabbet;
a first hinge pin fixedly mounted on and projecting from an inside surface of the first lateral wall of the lug, the first hinge pin including first and second opposed planar surfaces inclined at greater than a right angle with respect to the rabbet; and
a panel mountable on the frame for articulation with respect to the frame, the panel including a hook, the hook being defined by a hook wall that includes internal and external surfaces and that defines an interior of the hook, the hook wall including a first lateral opening of the hook that provides access to the interior of the hook from outside the hook, wherein
the hook is engageable with the first hinge pin by insertion of the first hinge pin through the first lateral opening into the interior of the hook, for pivoting of the panel between open positions, in which the central opening of the frame is open, and a closed position, in which the central opening of the frame is closed by the panel, with the panel being received within the peripheral rim of the frame and contacting the rabbet,
the first lateral opening has a width, relative to separation from each other of the first and second planar surfaces of the first hinge pin, so that the first hinge pin can pass through the first lateral opening only when the panel is at a first angle of inclination with respect to the rabbet, for mounting of the panel on the frame and removal of the panel from the frame, the first angle being larger than a right angle,
the hook, when the first hinge pin is in the interior of the hook, permits tilting of the panel about the first hinge pin to positions at which the angle of inclination of the panel with respect to the rabbet is larger and smaller than a right angle,
the lug includes a plurality of transverse surfaces, transverse to the first lateral wall and inclined with respect to each other, the transverse surfaces including a bottom transverse surface, an inclined transverse surface, and a steep side transverse surface that adjoins the bottom transverse surface and the inclined transverse surface and forms a step with the bottom and inclined transverse surfaces,
the hook wall comprises a top wall portion and a bottom wall portion respectively corresponding to top and bottom surfaces of the panel when the panel is in the closed position, and
the hook includes a heel comprising a projection projecting outwardly from the external surface of the bottom wall portion of the hook, the hook being located adjacent the first lateral opening, the heel contacting the steep side transverse surface and immobilizing the panel against tilting toward the closed position, with the panel in an upright position, substantially perpendicular to the rabbet, the internal surface of the hook and first hinge pin colliding and preventing removal of the panel from the frame upon lifting of the panel away from the frame, when the panel is in any position between the upright position and the closed position.

2. The device according to claim 1, wherein, when the panel is rotated about the first hinge pin to a position forming an angle of inclination with respect to the rabbet of at least the first angle, the panel rests on an external surface on the rim of the frame.

3. The device according to claim 1, wherein the heel of the hook functions as a cam that cooperates with the inclined transverse surface of the lug to control the tilting of the panel when the panel is moved from the closed position toward the open positions.

4. The device according to claim 1, wherein the panel is circular, the hook extends radially from the panel, and the lug is connected radially to the frame.

5. The device according to claim 1, wherein the first and second planar surfaces of the first hinge pin are inclined at an angle in a range from 110° to 120°, with respect to the rabbet.

6. The device according to claim 1, wherein the lug includes a second lateral wall, opposite the first lateral wall, and further comprising:
a second hinge pin fixedly mounted on and projecting from an inside surface of the second lateral wall of the lug, opposite and toward the first hinge pin, the second hinge pin including opposed first and second planar surfaces inclined with respect to the rabbet at the same angle as the opposed first and second planar surfaces of the first hinge pin, wherein
the hook includes a second lateral opening providing access to the interior of the hook from outside the hook, the hook being engageable with the second hinge pin by insertion of the second hinge pin through the second lateral opening into the interior of the hook for tilting of the panel between the open positions and the closed position, and
the second lateral opening has a width, relative to separation of the first and second planar surfaces of the second hinge pin, so that the second hinge pin can pass through the second lateral opening only when the panel is at the first angle of inclination with respect to the rabbet, for mounting of the panel on the frame and removal of the panel from the frame.

7. The device according to claim 6, wherein the first and second hinge pins are coaxial.

* * * * *